United States Patent [19]

Hauser et al.

[11] 4,097,139

[45] Jun. 27, 1978

[54] REPRODUCING MACHINE HAVING INTERCHANGEABLE DEVELOPER HOUSINGS

[75] Inventors: Oscar G. Hauser, Rochester; Thomas Meagher; Frederick R. Ruckdeschel, both of Webster, all of N.Y.

[73] Assignee: Xerox Corporation, Stamford, Conn.

[21] Appl. No.: 728,102

[22] Filed: Sep. 30, 1976

[51] Int. Cl.[2] ..... G03G 15/01

[52] U.S. Cl. ..... 355/4; 118/657; 355/3 DD

[58] Field of Search ..... 355/4, 3 DD; 118/653, 118/656, 657, 658; 427/21, 18

[56] References Cited

U.S. PATENT DOCUMENTS

| | | | |
|---|---|---|---|
| 3,976,372 | 8/1976 | Miyata et al. | 355/4 |
| 3,981,576 | 9/1976 | Inoue | 355/4 |
| 3,985,436 | 10/1976 | Tanaka et al. | 355/3 DD |
| 3,987,756 | 10/1976 | Katayama et al. | 355/4 |

FOREIGN PATENT DOCUMENTS

| | | | |
|---|---|---|---|
| 1,293,482 | 10/1972 | United Kingdom | 355/4 |

*Primary Examiner*—Richard L. Moses

[57] ABSTRACT

A reproducing machine in which a member has successive latent images recorded thereon. The reproducing machine includes a pair of developer units. One developer unit is located in the operative position in the reproducing machine with the other unit being remote therefrom. Each developer unit contains different colored particles. Color changes are achieved by interchanging developer units to develop one latent image with particles of one color and the other latent image with particles of the other color.

23 Claims, 5 Drawing Figures

REPRODUCING MACHINE HAVING INTERCHANGEABLE DEVELOPER HOUSINGS

BACKGROUND OF THE INVENTION

This invention relates generally to a reproducing machine, and more particularly concerns an improved development system for use therein.

In the process of electrostatographic printing, electrostatic latent charge patterns are recorded and reproduced in viewable form. The field of electrostatography includes electrophotography and electrography. Electrophotography is that which employs a photosensitive medium to form, with the aid of electromagnetic radiation, the electrostatic latent charge pattern. Electrophotography utilizes an insulating medium to form, without the aid of electromagnetic radiation the electrostatic latent charge pattern. Various types of reproducing machines have been developed which utilize both of the foregoing types of electrostatographic printing. Development, which is the act of rendering an electrostatic latent pattern or image viewable, is employed in all of the aforementioned classes of electrophotography. In the illustrative embodiment hereinafter discussed, an electrophotographic printing process is employed.

The process of electrophotographic printing, as described by Carlson in U.S. Pat. No. 2,297,691 and further amplified and disclosed by many related patents in the art, utilizes a photosensitive element having a photoconductive insulating layer which is charged to a uniform potential to sensitize the surface thereof. The charged photoconductive surface is exposed to a light image of an original document being reproduced. As a consequence of the exposure, the charge is selectively dissipated in the irradiated areas in accordance with the light intensity reaching the surface thereof. This records an electrostatic latent image on the photoconductive surface. Development of the electrostatic image recorded on the photoconductive surface is achieved by bringing a developer mix into contact therewith. A typical developer mix generally comprises dyed or colored heat settable plastic powders, known in the art as toner particles, which are mixed with coarse carrier granules, such as ferromagnetic granules. The toner particles and carrier granules are selected such that the toner particles acquire the appropriate charge relative to the electrostatic latent image recorded on the photoconductive surface. When the developer mix is brought into contact with the charged photoconductive surface, the greater attractive force of the electrostatic latent image recorded thereon causes the toner particles to transfer from the carrrier granules and adhere to the electrostatic latent image.

The reproducing machine may employ a high speed flash exposure of the original document and a moving photoconductive belt which is continuously charged. A reproducing machine of this type is provided with a developing system which supplies toner particles in relatively large quantities to achieve solid area coverage. A highly suitable system for this purpose is a magnetic brush developing apparatus. Hereinbefore, the magnetic brush development system would render the electrostatic latent image visible with colored toner particles. In a black and white reproduction system, the toner particles would be black. A detailed discussion of one such suitable type of system is described in U.S. Pat. No. 3,865,081 issued to Charland et al. in 1975. In this type of system the photoconductive surface of belt is exposed to a light image of the original document recording an electrostatic latent image thereon. The latent image is then developed with black toner particles. These toner particles are then transferred to the copy sheet and permanently affixed thereto. This results in a black and white copy of the original document.

With the advent of multi-color electrophotographic printing, a plurality of developer units are employed. In this type of system each magnetic brush developer unit contains discretely colored toner particles. For example, one developer unit contains yellow toner particles, another magenta toner particles an a third cyan toner particles. Thus, a colored original document is filtered to form a single color light image. This single color light image creates a single color electrostatic latent image on the photoconductive surface. The single color electrostatic latent image is then developed with toner particles of a color complementary to the color of the filtered light image. In this way, three single color toner powder images are developed on the photoconductive surface. Each single color toner powder image corresponds to the complement of the color information contained in the original document. These toner powder images are then transferred to the copy sheet in superimposed registration with one another to form a multi-color copy corresponding to the original document being reproduced. The foregoing was disclosed in U.S. Pat. No. 3,906,897 issued to Davidson in 1975 and many other patents relating thereto.

Recently, it has been found to be highly desirable to produce multi-color copies in high speed photoconductive belt electrophotographic printing machines. Thus, a high speed electrophotographic printing machine which is adaptable to producing black and white copies containing color highlighted information therein has many uses in a centralized reproduction facility. A machine of this type could reproduce an original document in a color other than black or in black, as well as producing color highlighted copies.

Accordingly, it is a primary object of the present invention to improve the development system employed in an electrophotographic printing machine so as to be able to produce black or colored copies therein.

SUMMARY OF THE INVENTION

Briefly stated, and in accordance with the present invention, there is provided a reproducing machine arranged to form different color copies.

Pursuant to the features of the present invention, the reproducing machine includes a member having successive latent images recorded thereon. First means develop at least one of the latent images recorded on the member with particles of a first color. Second means develop the other latent images recorded on the member with particles of a second color. Means are provided for replacing the first developing means with the second developing means. After developing the latent images recorded on the member with particles of the first color, the replacing means moves the first developing means to a position remote from the reproducing machine and inserts the second developing means in the operative position therein.

BREIF DESCRIPTION OF THE DRAWINGS

Other objects and advantages of the present invention will become apparent upon reading the following detailed description and upon reference to the drawings, in which.

While the present invention will hereinafter be described in connection with the preferred embodiment, and method associated therewith, it will be understood that it is not intended to limit the invention to that embodiment and method. On the contrary, it is intended to cover all alternatives, modifications, and equivalents as may be included within the spirit and scope of the invention as defined by the appended claims.

DETAILED DESCRIPTION OF THE INVENTION

Figure 1:
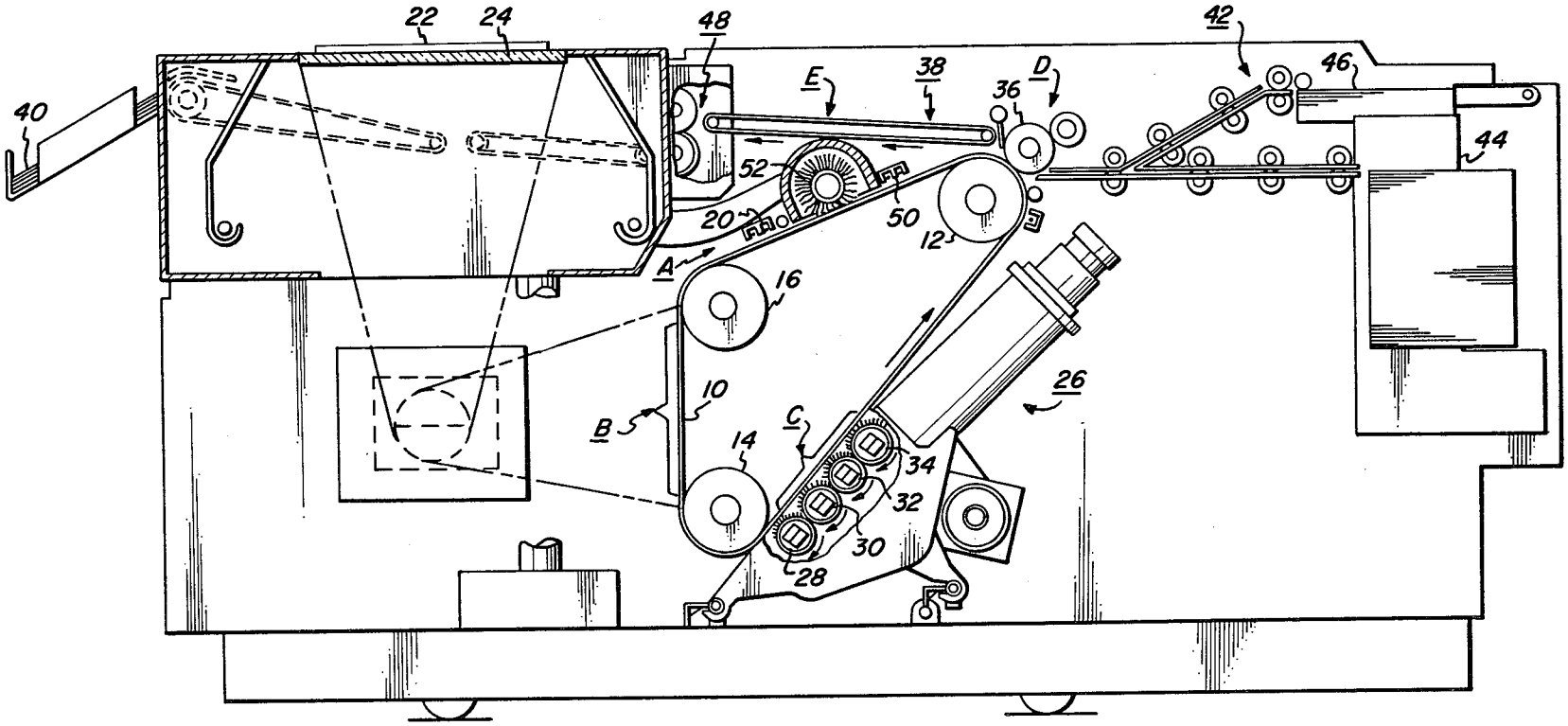
FIG. 1 is a schematic elevational view of an electrophotographic printing machine embodying the features of the present invention therein.

Turning now to the drawings, FIG. 1 depicts an electrophotographic printing machine incorporating the features of the present invention therein. In the drawings, like reference numerals have been used throughout to designate identical elements. The apparatus of the present invention insures that the reproducing machine forms a copy having at least two colors from at least two original documents. It should be noted that the two original documents may be the same original document with different portions thereof masked during each reproduction cycle. It will become evident from the following discussion that this apparatus is not only well suited for use in the electrophotographic printing machine depicted herein, but is also well adapted for use in any of a wide variety of electrostatographic printing machines and is not necessarily limited in its application to the particular embodiment shown herein.

Inasmuch as the art of electrophotographic printing is well known, the various processing stations employed in the FIG. 1 printing machine will be shown hereinafter schematically and their operation described briefly with reference thereto.

As shown in FIG. 1, the electrophotographic printing machine employs a photoconductive belt 10 which comprises a photoconductive layer of selenium on a conductive backing. Belt 10 is journaled for continuous movement upon three rollers, 12, 14, and 16, positioned with their axes in parallel. Roller 12 is rotatably driven by a suitable motor and drive assembly (not shown) to advance belt 10 in the direction of arrow 18 at a substantially constant velocity.

Initially, the surface of photoconductive belt 10 is sensitized. This is achieved at charging station A. Corona generating device 20 is disposed at charging station A and charges the surface of photoconductive belt 10 to a relatively high substantially uniform potential level.

Thereafter, the charged portion of photoconductive belt 10 rotates through exposure station B. Exposure station B illuminates an original document 22 disposed face down upon a substantially transparent platen 24. Light rays are flashed from the illumination system upon original document 22 to produce image rays corresponding to the informational areas therein. The image rays are projected by means of an optical system onto the charged portion of photoconductive belt 10. The portion of photoconductive belt 10 irradiated by the image rays is discharged. This records an electrostatic latent image on photoconductive belt 10 corresponding to the informational areas contained within original document 22. Original document 22 is the first of at least two original documents which must be positioned on platen 24 and have electrostatic latent images thereof recorded on belt 10 to obtain at least a two color copy. As previously indicated, original documents 22 may be different from one another or the same original document with different portions thereof selectively masked. Thus, the first original document disposed on platen 24 records a first electrostatic latent image corresponding to the information areas contained therein. Thereafter, the next successive original document is positioned on platen 24 and the next electrostatic latent image corresponding to the informational areas contained therein is recorded on photoconductive belt 10. The information areas contained within both of these original documents may be reproduced in black while the information areas contained within the other original document may be reproduced in a color other than black, i.e., red, yellow, blue, green, etc.

As photoconductive belt 10 continues its movement in the direction of arrow 18, the electrostatic latent image recorded thereon passes through development station C. At development station C, there is positioned a magnetic brush developing apparatus generally indicated by the reference numeral 26, which comprises carrier granules having toner particles adhering thereto. Generally, these carrier granules are formed from a ferromagnetic material while the toner particles are made from a heat settable plastic. In a typical magnetic brush system a chain-like array of developer mix extends in the outward direction from developer rolls 28, 30, 32, and 34. Each of the developer rolls is made from a non-magnetic tubular member such as aluminum having a regular or roughened exterior surface. The tubular member is rotated and a magnet is disposed in the interior thereof. In this way, the developer mixture is advanced from a sump in the housing of development system 26 to the development zone adjacent to photoconductive belt 10. The toner particles adhering to the carrier granules may be black or, in lieu thereof, may be a suitable color other than black. This depends upon the color in which the informational areas contained within original document 22 are being reproduced.

The developed electrostatic latent image is transported by belt 10 to a transfer station D located at a point of tangency on the belt as it moves around roller 12. A sheet of copy paper is moved at a speed in synchronism with the moving belt in order to accomplish transfer of the developed image. This is achieved by roller 36 which is mounted on the frame of the printing machine for contacting the non-transfer side of each sheet of copy paper as it is brought into engagement with belt 10. Transfer roller 36 may be biased electrically to a suitable magnitude and polarity so that the developed toner particle image on belt 10 is electrostatically transferred to the adjacent side of the copy sheet. This is achieved as the copy sheet is brought into contact with the toner powder image passing between transfer roller 36 and photoconductive belt 10. A stripping finger or air puffing device may be utilized to remove the sheet from roller 36 and to continue the movement thereof on a vacuum conveying system 38. The sheet is advanced by conveyor system 38 to catch tray 40 where the operator may remove it.

There is also provided a suitable sheet transport mechanism adapted to advance copy sheets in seriatim from a paper handling mechanism generally indicated by the reference numeral 42. As shown in FIG. 1, sheet feeding apparatus 42 may advance successive sheets from a stack 44. Alternatively, sheet feeding apparatus 42 may advance successive sheets from a stack 46. Stack 46 is positioned manually in the printing machine enabling the operator to place sheets, having information recorded therein in the machine for a second pass. It is this mode of operation that will be employed in reproducing a copy containing two or more colors.

As conveying system 38 advances the copy sheet with the toner powder image thereon to catch tray 40, it passes into a fuser assembly, generally indicated by the reference numeral 48. Fuser assembly 48 develops sufficient pressure and heat to permanently affix the toner powder image to the copy sheet. After fusing, the finished copy is discharged from fuser 48 to catch tray 40. The remaining toner particles adhering as residue, on photoconductive belt 10 pass through cleaning station E. At cleaning station E, a corona generating device 50 neutralizes the remaining charge on the toner particles and that of photoconductive belt 10. This enables brush 50, in contact with photoconductive belt 10, to remove the residual particles therefrom. Thereafter, the foregoing process is repeated for the next original document. However, in order to reproduce a two color copy, developing unit 26 is removed from the chamber in the housing of the electrophotographic printing machine and replaced with another developer unit. Thus, if the first original document is reproduced with black toner particles, developer unit 26 would, of necessity, have contained black toner particles therein. If the next successive original document is to be reproduced as red on the same copy sheet, developer unit 26 is removed and a new developer unit inserted into the chamber of the housing in the printing machine. This new developer unit will contain red toner particles therein. Hence, development system 26 is mounted removably in the chamber of the housing of the electrophotographic printing machine. For example, developer unit 26 may be mounted on a pair of opposed spaced substantially parallel bars. In this way, developer unit 26 may be slid in an outwardly direction so as to be removed from the electrophotographic printing machine. The interchangeability of developer housing 26 will be discussed hereinafter in greater detail with reference to FIGS. 2 through 5, inclusive. However, it should be noted that not only must the developer unit be changed, but the copy sheet containing the informational areas of the first original document in the first color, i.e. black, must be placed face down on stack 46 and re-run through the electrophotographic printing machine so that the next successive toner powder image may be transferred thereto. In this way, the copy sheet will have two toner powder images transferred thereto. Each of these toner powder images will be of a different color. It should be noted that it is not required to reproduce each original document successively. Thus, a plurality of copy sheets may be formed from the first original document and these original documents disposed on stack 46. Thereafter, the next successive original document is disposed on platen 24 and a new development system 26 inserted into the printing machine after the first developer unit is removed therefrom. The machine is then activated to reproduce the same number of copy sheets as was reproduced during the first cycle. In this way, each of the copy sheets on stack 46 receives the information contained within the second original document in a second color. Thus, the resultant copy sheets contain two colors. The foregoing process may be repeated for any number of original documents so that the resultant copy sheet may contain a large variety of different colors thereon. It should be noted that the original documents disposed on platen 24 may not necessarily be different original documents but may be the same original document with selective portions thereof masked by opaque strips. For example, if it is desired to reproduce the first paragraph of a letter in black and the remaining portions of the letter in red, initially, only the first portion of the letter would remain unmasked when the development system containing black toner particles was in the printing machine. Thereupon, the printing machine would be activated and the plurality of copies formed containing only the information of the first paragraph which would appear as black on the copy sheets. Thereafter the first paragraph of the letter or original document would be masked. Development system 26 is replaced with a development system containing red toner particles. The copy sheets containing the black information are disposed on stack 46 face down. The machine is activated and the remaining portion of the letter reproduced on the copy sheets in red. In this manner, one paragraph of the copy of the letter would contain black information and the remaining portions thereof would be in red.

It is believed that the foregoing description is sufficient for purposes of the present application to illustrate the general operation of an electrophotographic printing machine incorporating the features of the present invention therein.

Figure 2:
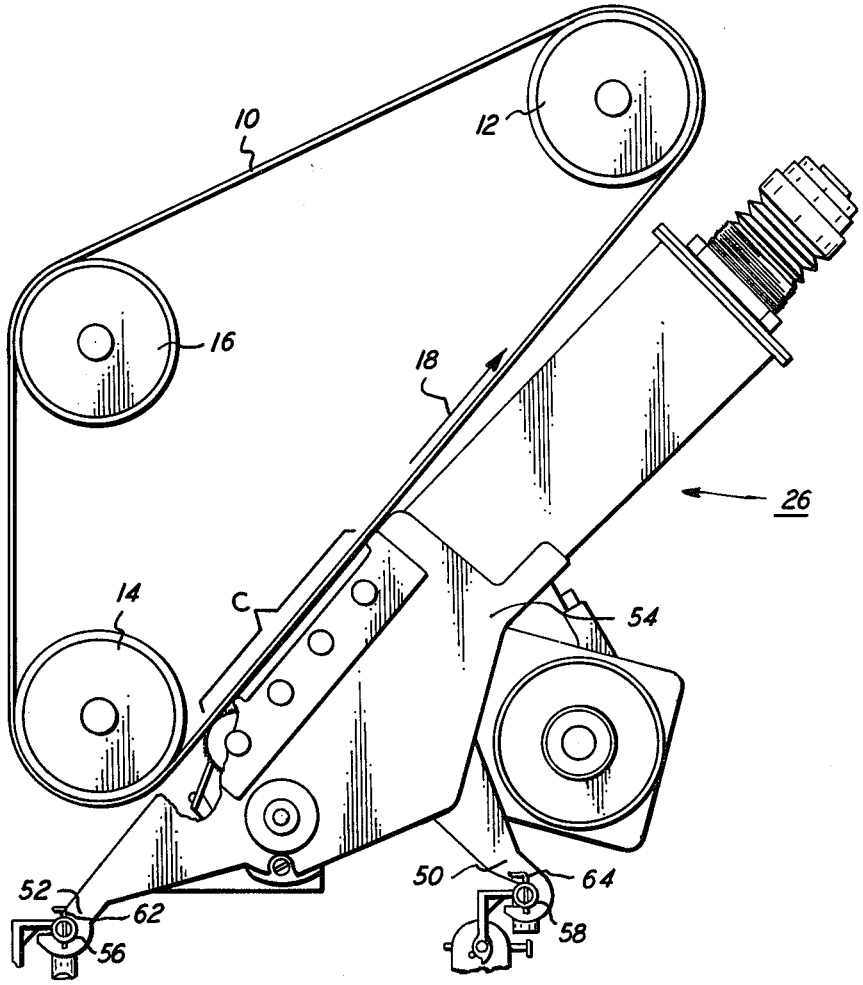
FIG. 2 depicts the development system of the FIG. 1 printing machine in the operational location.
Figure 4:
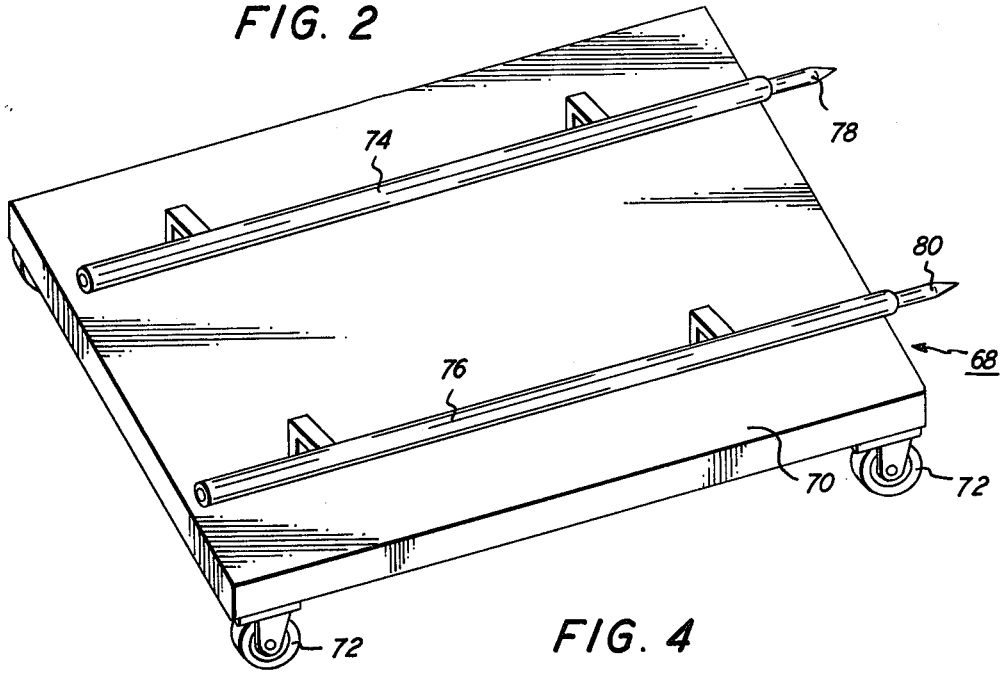
FIG. 4 is a schematic perspective view of a cart adapted to interchange development systems.

Referring now to the specific subject matter of the present invention, FIGS. 2 through 5, inclusive, depict the interchangeability of the development housing employed in the FIG. 1 electrophotographic printing machine. Turning now to FIG. 2, there is shown development system 26 in the operative location in the chamber of the electrophotographic printing machine. As shown therein, mounting hooks 50 and 52 support shell 54 of development unit 26. Hooks 50 and 52 slide onto bars 56 and 58 which are secured to the housing of the printing machine. In this manner, bars 56 and 58 support developer unit 26 in the chamber of the housing within the electrophotographic printing machine. Preferably, bars 50 and 56 are made from a suitable stainless steel and extend with the longitudinal axes thereof substantially parallel to one another. The bars are opposed and spaced from one another a distance equal to the distance between hooks 50 and 52. Thus, developer unit 26 is mounted slideably in the chamber of the housing within the electrophotographic printing machine on bars 56 and 58. After the first original document is reproduced in the first color, the copy sheets are returned to the printing machine and developer unit 26 is removed therefrom. The process of removing developer unit 26 from printing machine will be described hereinafter with reference to FIG. 3.

Figure 3:
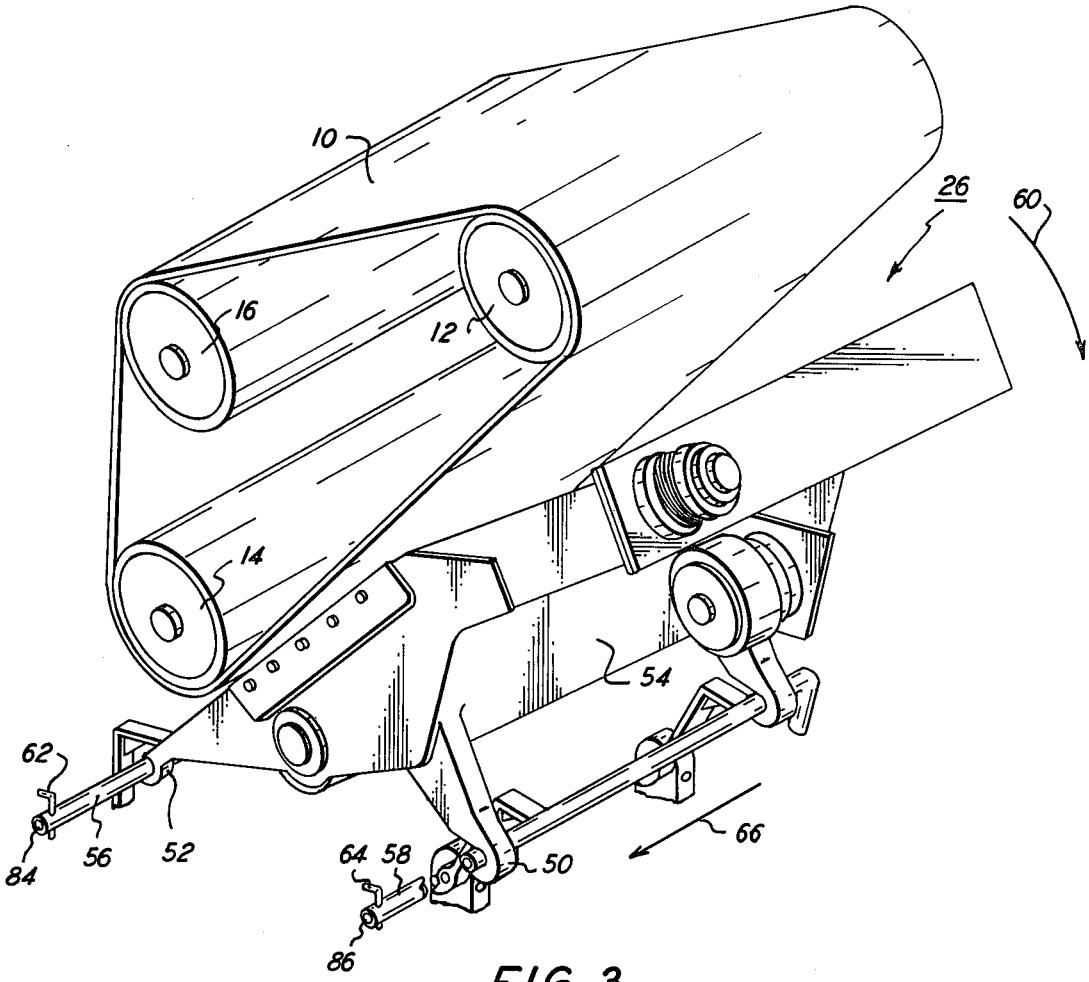
FIG. 3 is a schematic perspective view of the FIG. 2 development system and the mounting arrangement, shown fragmentarily, therefor.

Referring now to FIG. 3, developer unit 26 is supported in the operative position as shown in FIG. 2 by a cam (not shown). The cam is manually pivoted in the direction of arrow 60 causing developer unit 26 to pivot away from photoconductive belt 26 in the direction of arrow 60. Thereafter, pins 62 and 64 are removed from bars 56 and 58, respectively. This permits developer unit 26 to be slid in the direction of arrow 66 and removed from the electrophotographic printing machine to a position remote therefrom. After developer unit 26 is removed from the printing machine, the next successive developer unit containing toner particles of a different color is inserted therein. This is achieved by sliding the next developer unit onto bars 56 and 58, inserting pins 62 and 64 into bars 56 and 58 and camming developer unit 26 in the direction opposite to arrow 60 until the developer unit engages a stop (not shown) which located it in the operative position. As previously noted, the developer unit is removed slideably from the chamber of the electrophotographic printing machine and disposed on a movable cart. The movable cart is shown in detail in FIG. 4.

With continued reference to the drawings, the movable cart is indicated generally by the reference numeral 68. Cart 68 includes a generally planar substantially rectangular plate 70 mounted on rollers 72. Bars 74 and 76 are mounted fixedly on plate 70. Bars 74 and 76 are cylindrical and have end portions 78 and 80 respectively, tapered conically. End portions 78 and 80 mate with apertures or holes in cylindrical bars 56 and 58 mounted fixedly in the chamber of the housing of the electrophotographic printing machine. This mating procedure will be described hereinafter with reference to FIG. 5.

Figure 5:
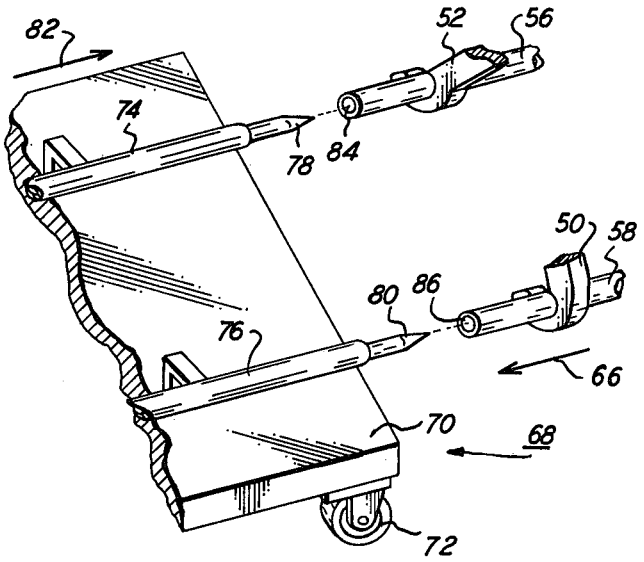
FIG. 5 is a fragmentary perspective view depicting the mating between the FIG. 4 cart and the mount supporting the FIG. 2 development system.

Referring now to FIG. 5, the removal of a development system from the chamber of the housing in the electrophotographic printing machine and the replacement therewith with the next development system containing a different color therein will be described. As shown in FIG. 5, cart 68 is advanced in the direction of arrow 82. Cart 68 is moved in the direction of arrow 82 until the respective conical portions 78 and 80 of bars 74 and 76 mate with holes 84 and 86 in bars 56 and 58, respectively. When bars 74 and 76 mate with bars 56 and 58 development system 26 is cammed in the direction of arrow 60 to position the development unit remote from the photoconductive belt 10. At that time, pins 62 and 64 are removed from bars 56 and 58. Thereafter, development system 26 is moved in the direction of arrow 66 onto bars 74 and 76 of cart 68. Cart 68 is then moved away from the electrophotographic printing machine and bars 74 and 76 disengaged from bars 56 and 58. At this time, the next successive development system on the next cart is moved so that bars 74 and 76 of this cart mate with bars 56 and 58 in the chamber of the housing of the printing machine. Then the development unit mounted on cart 68 is slid in the direction of arrow 82 onto bars 56 and 58. Thereafter, the new development system mounted on bars 56 and 58 is pivoted in a direction opposed to arrow 60 so as to be in the operative location closely adjacent to the photoconductive belt 10. At this time, pins 62 and 64 are inserted into bars 56 and 58, respectively, locking development system 26 in the operative position. In this manner, developer units may be readily interchanged so as to change the colors being formed on the copy sheet.

While the present invention has been described in connection with an interchangeable magnetic brush system so as to produce a copy having at least two colors thereon, it is evident that a plurality of colors may be formed on the copy sheet from a plurality of different developer units. Moreover, one skilled in the art will appreciate that the invention is not necessarily limited to magnetic brush development systems and any suitable development system such as cascade development, fur brush development, etc. may be employed in lieu thereof.

In recapitulation, it is apparent that the electrophotographic printing machine hereinbefore described employs an interchangeable development system so as to produce a color copy having at least two different colors thereon. The foregoing is achieved by utilizing at least two original documents and at least two development systems. Each development system contains differently colored toner particles therein so that the successive latent images formed from each original document are developed with differently colored toner particles. These toner particles are transferred to a common copy sheet producing a two-color copy therefrom.

It is, therefore, evident that there has been provided in accordance with the present invention, an apparatus and method for reproducing a copy in at least two colors from at least two original documents. The reproducing machine heretofore described achieves the foregoing and fully satisfies the objects, aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations that fall within the spirit and broad scope of the appended.

What is claimed is:

1. A reproducing machine, including:

a member arranged to have successive latent images recorded thereon, first means for developing at least one of the latent images recorded on said member with particles of a first color;

second means for developing the other latent images recorded on said member with particles of a second color;

first means for moving said first developing means from an operative position in communication with the latent images to an inoperative position external to the reproducing machine; and second means for moving said second developing means from the inoperative position external to the reproducing machine to the operative position in communication with the latent images after said first moving means moves said first developing means to the inoperative position.

2. A reproducing machine, including:

a member arranged to have successive latent images recorded thereon, first means for developing at least one of the latent images recorded on said member with particles of a first color;

second means for developing the other latent images recorded on said member with particles of a second color;

means for supporting removably said first developing means in an operative position in the reproducing machine;

means for receiving said first developing means from said supporting means and moving said first developing means to a position remote from the reproducing machine; and means for holding removably said second developing means and locating said second developing means in the operative position in the reproducing machine after said receiving means moves said first developing means to the remote position.

3. A reproducing machine as recited in claim 2, wherein:

said receiving means includes a movable first cart arranged to have said first developing means disposed removably thereon; and said holding means includes a movable second cart arranged to have said second developing means disposed removably thereon.

4. A reproducing machine as recited in claim 3, wherein said supporting means includes a first pair of opposed, spaced, substantially parallel bars mounted fixedly in the reproducing machine with one of said developing means being mounted slideably thereon.

5. A reproducing machine as recited in claim 4, wherein said first cart and said second cart are substantially identical to one another and each includes:

a movable generally planar member; and a second pair of opposed, spaced, substantially parallel bars mounted fixedly on said planar member with one of said developing means being arranged to be mounted slideably thereon, said second pair of bars mating with said first pair of bars when said planar member positions said second pair of bars in engagement with said first pair of bars.

6. An electrophotographic printing machine, including:

a photoconductive member;

means for recording successive latent images on said photoconductive member;

first means for developing at least one of the latent images recorded on said photoconductive member with particles of a first color;

second means for developing one of the latent images recorded on said photoconductive member with particles of a second color;

first means for moving said first developing means from an operative position in communication with the latent images to an inoperative position external to the printing machine; and second means for moving said second developing means from the inoperative position external to the printing machine to the operative position in communication with the latent images after said first moving means moves said first developing means to the inoperative position.

7. An electrophotographic printing machine, including;

a photoconductive member;

means for recording successive latent images on said photoconductive member;

first means for developing at least one of the latent images recorded on said photoconductive member with particles of a first color;

second means for developing one of the latent images recorded on said photoconductive member with particles of a second color;

means for supporting removably said first developing means in an operative position in the printing machine;

means for receiving said first developing means from said supporting means and moving said developing means to a position remote from the printing machine; and means for holding removably said second developing means and locating said second developing means in the operative position in the printing machine after said receiving means moves said first developing means to the remote position.

8. A printing machine as recited in claim 7, wherein:

said receiving means includes a movable first cart arranged to have said first developing means disposed removably thereon; and said holding means includes a movable second cart arranged to have said second developing means disposed removably thereon.

9. A printing machine as recited in claim 8, wherein said supporting means includes a first pair of opposed, spaced substantially parallel bars mounted fixedly in the printing machine.

10. A printing machine as recited in claim 9, wherein said first cart and said second cart are substantially identical to one another and each includes:

a movable, generally planar member; and a second pair of opposed, spaced, substantially parallel bars mounted fixedly on said planar member with one of said developing means being arranged to be mounted slideably thereon, said second pair of bars mating with said first pair of bars when said planar member positions said second pair of bars in engagement with said first pair of bars.

11. A printing machine as recited in claim 7, further including means for transferring the particles to a copy sheet.

12. A printing machine as recited in claim 11, further including means for permanently affixing the particles to the copy sheet.

13. A printing machine as recited in claim 12, wherein said recording means includes:

means for charging at least a portion of said photoconductive member to a substantially uniform level; and means for exposing the charged portion of said photoconductive member to a light image of one of the original documents to record a latent image thereof on said photoconductive member.

14. An apparatus for applying particles of a first color and particles of a second color to electrostatic latent images recorded on a photoconductive member, including:

a housing defining a chamber in communication with the photoconductive member;

a first magnetic brush unit arranged to be disposed in the chamber of said housing to develop the latent images recorded on the photoconductive member with particles of a first color;

a second magnetic brush unit arranged to be disposed in the chamber of said housing to develop the latent image recorded on the photoconductive member with particles of a second color;

first means for moving said first magnetic brush unit from an operative position in communication with the latent images to an inoperative position external to the apparatus; and second means for moving said second magnetic brush unit from the inoperative position external to the apparatus to the operative position in communication with the latent images after said first moving means moves said first magnetic brush unit to the inoperative position.

15. An apparatus for applying particles of a first color and particles of a second color to electrostatic latent images recorded on a photoconductive member, including;

a housing defining a chamber in communication with the photoconductive member;

a first magnetic brush unit arranged to be disposed in the chamber of said housing to develop the latent images recorded on the photoconductive member with particles of a first color;

a second magnetic brush unit arranged to be disposed in the chamber of said housing to develop the latent image recorded on the photoconductive member with particles of a second color;

means for supporting movably said first magnetic brush unit in an operative position in the reproducing machine;

means for receiving said first magnetic brush unit from said supporting means and moving said first magnetic brush unit to a position remote from the chamber in said housing; and means for holding removably said second magnetic brush unit and locating said second magnetic brush unit in the operative position in the chamber of said housing after said receiving means moves said first magnetic brush unit to the remote position.

16. An apparatus as recited in claim 15, wherein:

said receiving means includes a movable first cart arranged to have said first magnetic brush unit disposed removably therein; and said holding means includes a movable second cart arranged to have said second magnetic brush unit disposed removably thereon.

17. An apparatus as recited in claim 16, wherein said supporting means includes a first pair of opposed, spaced, substantially parallel bars mounted fixedly in the chamber of said housing with one of said magnetic brush units being mounted slideably thereon.

18. An apparatus as recited in claim 17, wherein said first cart and said second cart are substantially, identical to one another and each includes:

a movable, generally planar member; and a second pair of opposed, spaced, substantially parallel bars mounted fixedly on said planar member with one of said magnetic brush units being arranged to be mounted slideably thereon, said second pair of bars mating with said first pair of bars when said planar member positions said second pair of bars in engagement with said first pair of bars.

19. A method of reproducing a copy in at least two colors from at least two original documents, including the steps of:

recording a plurality of latent images on a member, each latent image corresponding to one of the original documents;

activating a first unit to develop the latent images corresponding to one of the original documents with particles of a first color;

moving the first unit from an operative position in communication with the latent images, to an inoperative position external to the copying machine;

moving a second unit from the inoperative position external to the copying machine to the operative position in communication with the latent images after the first unit moves to the inoperative position; and activating the second unit to develop the latent images corresponding to the other original document with particles of a second color.

20. A method of reproducing a copy in at least two colors from at least two original documents, including the steps of;

recording a plurality of latent images on a member, each latent image corresponding to one of the original documents;

activating a first unit to develop the latent images corresponding to one of the original documents with particles of a first color;

moving a first cart into operative communication with the first unit disposed in the operative location;

sliding a first unit from the operative location onto the first cart;

removing the first cart with the first unit disposed thereon from the operative location to a position remote therefrom;

advancing a second cart with the second unit mounted thereon into the operative location from a position remote therefrom after said step of removing;

sliding the second unit from the second cart into the operative location; and activating the second unit to develop the latent images corresponding to the other original document with particles of a second color.

21. A method as recited in claim 20, further including the step of transferring the particles of the first color and the particles of the second color to a copy sheet.

22. A method as recited in claim 20, further including the step of affixing substantially permanently the particles to the copy sheet forming a color copy.

23. A method as recited in claim 21, wherein said step of recording includes the steps of:

charging at least a portion of a photoconductive member to a substantially uniform level; and exposing the charged portion of the photoconductive member to a light image of one of the original documents to record a latent image thereof on the photoconductive member.

* * * * *